US009481075B2

(12) United States Patent
Gregory

(10) Patent No.: US 9,481,075 B2
(45) Date of Patent: Nov. 1, 2016

(54) HYDRAULIC PRESS PLIERS POWER HAND TOOL

(71) Applicant: Jack T Gregory, Sonoma, CA (US)

(72) Inventor: Jack T Gregory, Sonoma, CA (US)

(73) Assignee: Jack T Gregory and Nailia R Gregory Co, Sonoma, CA (US), Trustees of the 2015 Jack T Gregory and Nailia R Gregory Trust ( * ) Notice: Subject to any disclaimer, the term of this patent is extended or adjusted under 35 U.S.C. 154(b) by 151 days.

(21) Appl. No.: 14/182,260

(22) Filed: Feb. 17, 2014

(65) Prior Publication Data

US 2014/0230615 A1 Aug. 21, 2014

Related U.S. Application Data

(60) Provisional application No. 61/767,675, filed on Feb. 21, 2013.

(51) Int. Cl.
*B25B 7/00* (2006.01)
*B25B 7/12* (2006.01)
*B25B 7/02* (2006.01)

(52) U.S. Cl.
CPC ..... *B25B 7/126* (2013.01); *B25B 7/02* (2013.01); *B25B 7/12* (2013.01)

(58) Field of Classification Search
CPC ..... B25B 7/126; B25B 7/12; B25B 7/02
USPC ..... 81/301
See application file for complete search history.

(56) References Cited

U.S. PATENT DOCUMENTS 2,487,281 A * 11/1949 Steckelberg ..... B25B 7/123 81/301
2,778,259 A * 1/1957 Moir ..... B25B 7/123 188/314
3,372,479 A * 3/1968 Fischer ..... B25B 7/126 30/180
3,706,245 A * 12/1972 Van Schaik ..... B26B 17/02 30/180
4,031,619 A * 6/1977 Gregory ..... B25B 5/061 30/180

(Continued)

*Primary Examiner* — Hadi Shakeri
*Assistant Examiner* — Danny Hong
(74) *Attorney, Agent, or Firm* — Gary Hoenig

(57) ABSTRACT

A hand operated hydraulic press pliers tool is provided comprising an upper stationary handle having a fixed serrated upper jaw portion forming the front end of the stationary handle and a tubular portion forming the rear end of the stationary handle. A serrated lower jaw is pivotally attached to the stationary handle and disposed opposing the upper jaw portion. A hydraulic cylinder assembly is centrally disposed within the upper stationary handle and pivotally attached at one end within the tubular portion of the upper stationary handle near the rear of the handle, and the front end of the cylinder assembly pivotally attached to the lower serrated jaw between the lower jaw pivot handle attachment point and the serrated portion of the jaw. A lower tool handle is pivotally attached to the cylinder assembly yoke that is the front end of the pump assembly. A pivotally attached lower tool handle provides a pump lever disposed to engage a concentrically disposed hydraulic pump assembly within the cylinder assembly wherein depressing the top of the hydraulic pump assembly forces fluid into the cylinder assembly expanding the length of the cylinder assembly when the handles are squeezed together by a user. The longitudinal expansion pivots the lower serrated jaw towards the upper serrated jaw gripping a work piece disposed by a user between the jaws. Repeated cycles of squeezing and releasing the handles of the tool effectuate an incremental closure of the jaws onto a work piece with increasing pressure with each squeezing cycle.

15 Claims, 4 Drawing Sheets

(56) References Cited

U.S. PATENT DOCUMENTS 4,136,549 A * 1/1979 Lytle ..... H01R 43/0427 29/751
4,248,077 A 2/1981 Gregory
4,263,801 A 4/1981 Gregory
4,342,216 A 8/1982 Gregory
4,351,097 A * 9/1982 Hashimoto ..... B25B 7/12 29/229
4,489,471 A 12/1984 Gregory
4,689,957 A * 9/1987 Gallentine ..... B25B 1/18 60/477
4,735,048 A 4/1988 Gregory
4,947,672 A * 8/1990 Pecora ..... B21F 15/06 137/512.3
6,532,635 B1 3/2003 Gregory
7,251,980 B2 * 8/2007 Gallentine ..... B25B 7/123 72/409.01
7,464,578 B2 * 12/2008 Ayer ..... B25B 27/10 60/477
8,286,461 B2 * 10/2012 Hofmann ..... B25B 27/10 29/751
8,307,525 B2 11/2012 Gregory

* cited by examiner

HYDRAULIC PRESS PLIERS POWER HAND TOOL

RELATED APPLICATIONS

This non-provisional utility patent application, filed in the United States Patent and Trademark Office, claims the benefit of U.S. Provisional Patent Application Ser. No. 61/767,675 filed Feb. 21, 2013 which is hereby incorporated by reference.

FIELD OF THE INVENTION

The present invention relates to the field of press pliers hand tools. More particularly, this invention is directed to a hydraulically assisted press pliers hand tool.

BACKGROUND OF THE INVENTION

Utilizing a hand tool to apply pressure to a work piece is typically limited by the mechanical advantage provided by the tool and the hand strength of a user. Application of higher pressures typically requires assistance of a hydraulic pump and cylinder mechanism requiring mechanisms that either render the tool too bulky to considered a hand tool or too complex and expensive for causal use. Further hydraulically assisted systems can exhibit reliability issues and typically require routine maintenance. What is needed is a simple hydraulic hand tool capable of providing high pressure to a work piece while being simple to use, reliable, simple to manufacture, low cost and easy to maintain.

BRIEF SUMMARY OF THE INVENTION

Accordingly, it is an object of the present invention to provide a new type of press pliers hand tool having high reliability, simplicity, low maintenance, low complexity, ease of use and low cost thereby overcoming the various disadvantages of the prior art.

A hand operated hydraulic press pliers tool is provided comprising an upper stationary handle having a fixed serrated upper jaw portion forming the front end of the stationary handle and a tubular portion forming the rear end of the stationary handle. A lower serrated jaw is pivotally attached to the upper stationary handle and disposed opposing the upper jaw. A hydraulic cylinder assembly, having a front and rear end, is further centrally disposed within the tubular portion of the upper stationary handle with the cylinder assembly rear end pivotally attached within the tubular portion of the upper stationary handle near the rear of the handle, and the front end of the cylinder assembly pivotally attached to the lower serrated jaw between the lower jaw pivot handle attachment point and the serrated portion of the jaw. A lower tool handle, having a proximate and distal end, is pivotally attached, at the lower tool handle proximate end, to the cylinder assembly yoke, the yoke being the front end of the cylinder assembly. The lower tool handle further provides a handle pump lever disposed to engage the top of the hydraulic pump assembly wherein depressing the top of the pump assembly forces fluid into the hydraulic cylinder assembly thereby expanding the length of the cylinder assembly when the lower moving handle and the upper stationery handle are squeezed together by a user. The longitudinal expansion of the cylinder assembly pivots the lower serrated jaw towards the upper serrated jaw gripping a work piece disposed by a user between the jaws. When the lower moving handle is retracted, valves within the pump assembly retain hydraulic fluid within the hydraulic cylinder assembly and the extended length and pressure is maintained, additional hydraulic fluid is drawn into the pump assembly on this back stroke and the cylinder assembly again extends in longitudinal length and internal pressure increases on the next forward stroke. Repeated cycles of squeezing and releasing the handles of the tool effectuate an incremental closure of the jaws onto a work piece with increasing pressure with each squeezing cycle.

Releasing the press pliers from a work piece requires a user to activate a release handle being pivotally attached to the lower moving handle and having a release lever cam disposed to engage a release collar disposed around the circumference of the pump piston assembly centrally disposed within the tool piston portion of the hydraulic cylinder assembly. The distal end of the pump piston has a push pin centrally disposed to engage the pump outlet check valve that maintains the pressure within the hydraulic cylinder assembly, forcing the valve open and relieving hydraulic fluid out of the hydraulic cylinder assembly and ultimately back to a hydraulic fluid reservoir ready for being drawn back into the hydraulic pump assembly when the tool next engages a work piece.

Preloaded check valve springs, all centrally and longitudinally disposed, are provided to insure that a user cannot over pressure the hydraulic fluid of tool or damage the tool, principally through repeatedly squeezing the handles of the tool with the jaws clenched, by venting hydraulic fluid back to the reservoir or preventing the uptake of fluid into the pump. When preset pressures are attained, the pump assembly will not extend further in length or increase applied pressure between the jaws.

The elements of the pump assembly are longitudinally disposed within each other making manufacturing and assembly simple and low cost. The elements are also arranged to minimize the total number of components wherein single elements provide combined functions required by hydraulic pumping systems having lower mechanical tolerances and lower cost material types than typically required thus providing further lower cost advantages, reliability and a compact, light weight design necessary for hand tools. The hydraulic assist facilitates application of pressure to a work piece much higher than obtainable with similar sized mechanical hand tools.

What is needed is a new type of hydraulic cylinder and pump combination as provided by a multifunction pump valve, piston and cylinder facilitated by a valve crowd assembly integrated into a hydraulic cylinder as accomplished by the present invention as herein disclosed.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

DETAILED DESCRIPTION OF THE INVENTION

Figure 1:
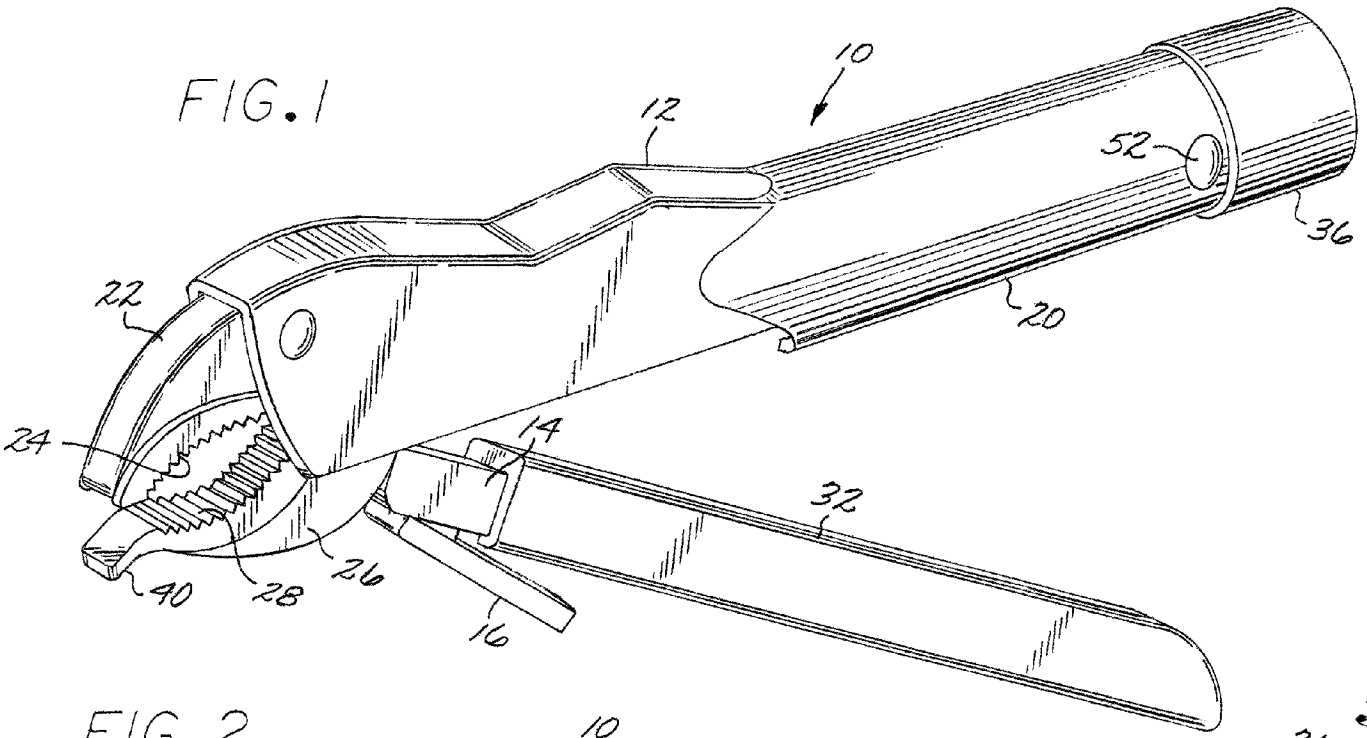
FIG. 1 is a isometric view of an embodiment of the press pliers according to the present invention wherein the essential features of the apparatus are visible including the upper stationary handle, jaws, release lever and lower moving handle.

Although particular embodiments of the invention have been described in detail for purposes of illustration, various modifications may be made without departing from the spirit and scope of the invention. Accordingly, the invention is not to be limited except as by the appended claims. Referring now in greater detail to the various figures of the drawings wherein like reference characters refer to like parts, there is shown in an isometric view at 10 in FIG. 1, a new type of hydraulically activated press pliers hand tool.

Figure 2:
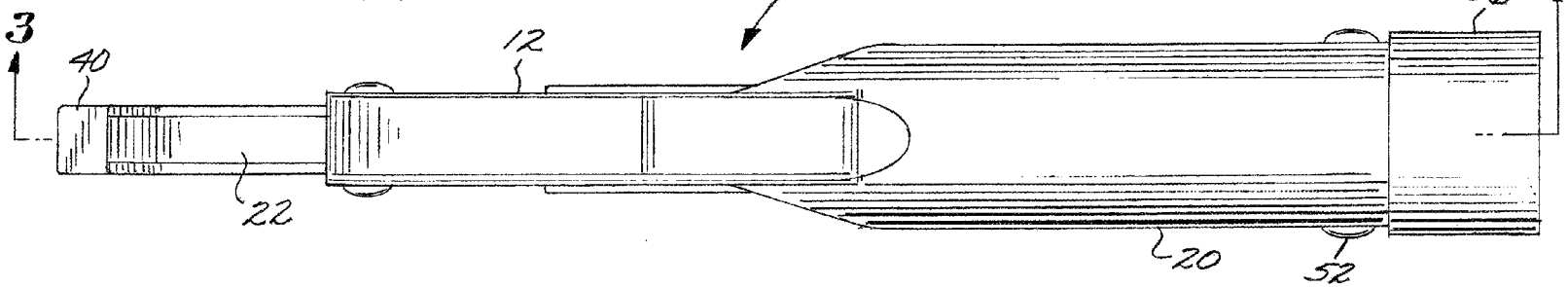
FIG. 2 is a top plan view of the press pliers of FIG. 1.

FIGS. 1 and 2 illustrate the press pliers 10 according to the present invention having an upper stationary handle 12 having a tubular rear portion 20 and an upper serrated jaw portion 22 forming the front end of the handle 12. The upper serrated jaw portion 22 has serrations 24 disposed downwardly and opposing lower serrated jaw 26 upwardly facing serrations 28 for engaging and gripping a work piece provided by a user. A lower moving handle 14 is provided with optional lower moving handle grip 32 and arranged to activate a hydraulic cylinder assembly centrally disposed within the upper stationary handle 12. The lower jaw pivots towards the upper jaw with increasing pressure as a user repeatedly squeezes the lower and upper handles together. The hydraulic pressure on the jaws is released when release handle 16 is depressed by a user. Lower serrated jaw lip 40 provides a lever handle for a user to manually spread the jaws apart when the hydraulic pressure is released.

Figure 3:
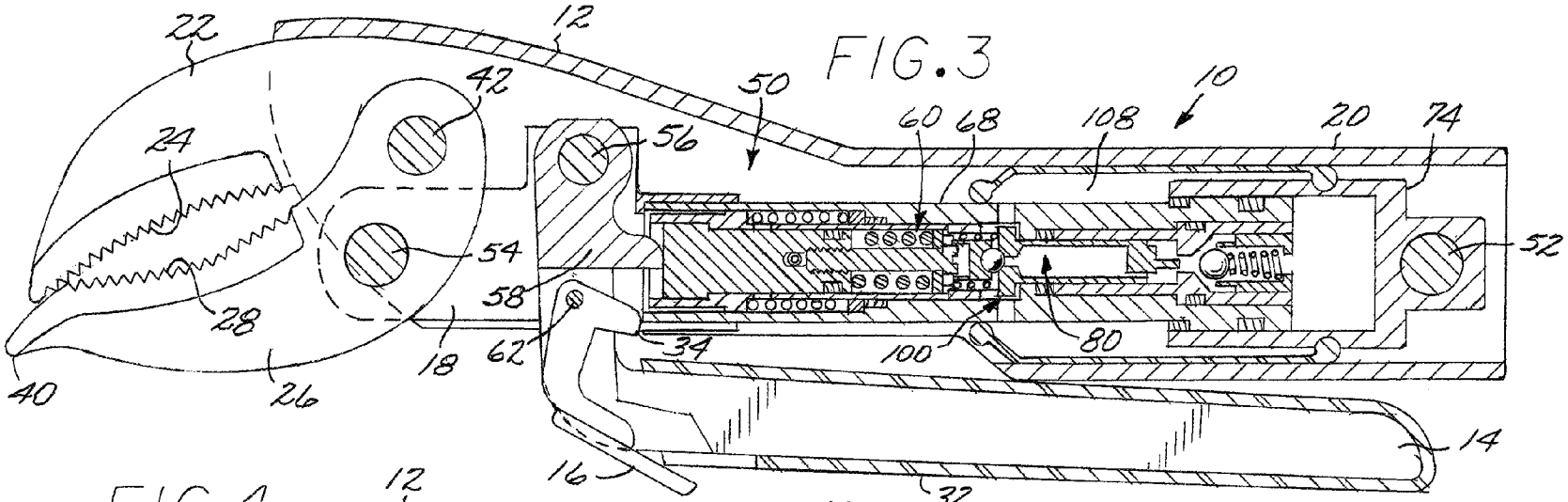
FIG. 3 is a side elevation cross sectional view taken along Line 3-3 of FIG. 2 wherein showing the spatial relationship of the various elements according to the present invention.

Referring now to FIG. 3 showing a full cross section of the invention, details of the various elements of the press pliers are illustrated showing the press pliers tool comprising an upper stationary handle 12 having a tubular rear portion 20 and an upper serrated jaw portion 22 forming the front end of the handle 12, a lower serrated jaw 26 being pivotally fixed at the pivot end to the upper stationary handle 12 by the lower serrated jaw pivot pin 42. The lower serrated jaw 26 has a front end with the serrations 28 disposed opposing the serrations 24 of the upper serrated jaw 22 of the upper stationary handle 12. A hydraulic cylinder assembly 50 is centrally and longitudinally disposed within the upper stationary handle 12. The hydraulic cylinder assembly 50, having a front and rear end, is pivotally attached to the tubular rear portion 20 of the upper stationary handle 12 by hydraulic cylinder assembly rear pivot pin 52, the pivot pin 52 being horizontally and perpendicularly fixed to the inside diameter of the tubular rear portion 20 near the rear end of the handle 12. An optional upper stationary handle rear dust cap 36 may be provided disposed to cover the tubular portion 20 rear opening. The front end of the hydraulic cylinder assembly 50 is comprised of yoke 18 and is pivotally attached to the lower serrated jaw 26 by cylinder assembly front pivot pin 54. Pivot pin 54 is fixed to the lower serrated jaw 26 at a location offset between the jaw pivot pin 42 and the serrated portion 28 of the lower serrated jaw 26. The longitudinal length of the hydraulic cylinder assembly 50 extends when activated by the user thereby pressing against pivot pin 54 and necessarily leveraging lower serrated jaw 26 to rotate around jaw pivot pin 42 thrusting the serrations 28 upwardly towards the serrations 24 of the upper jaw 22 and hence engaging and gripping a work piece disposed between the serrations.

The hydraulic cylinder assembly 50 essentially comprises a yoke 18 forming the front end, a tool piston assembly 68 fixed to the yoke 18, a tool cylinder 74 slideably engaging the rear end of the tool piston assembly 68, and a hydraulic fluid reservoir 108 around a portion of the circumference of the hydraulic cylinder assembly 50. Hydraulic fluid flowing into the tool cylinder 74 during a forward stroke forces the tool piston assembly 68 outwardly extending the length of the hydraulic cylinder assembly 50. The tool piston assembly 68 further comprises a hydraulic pump assembly 80 longitudinally and concentrically disposed within the tool piston assembly 68. The hydraulic pump assembly 80 is activated by moving the lower moving handle 14 to depress the front end of the tool piston assembly 68 containing a crowd assembly 60 of the hydraulic pump assembly 80.

Again referring to FIG. 3, activation of the hydraulic cylinder assembly 50 is accomplished by rotating lower moving handle 14 towards the upper stationary handle 12 wherein the lower moving handle 14 is pivotally attached to the yoke 18 of the hydraulic cylinder assembly 50 by lower moving handle pivot pin 56 located near the proximate end of the handle 14. The lower moving handle 14 has a pump lever 58 fixed near the proximate end and disposed to contact and press centrally on the crowd assembly 60 of the hydraulic piston assembly 100. The tool is therefore activated by a user by pressing the lower moving handle 14 and the upper stationary together rotating the lower moving handle 14 around the proximate end pivot in 56 thereby pressing and leveraging the pump lever 58 towards the hydraulic pump assembly 80. Similarly a release handle 16 is provided, pivotally attached at the release handle proximate end, to the lower moving handle 14 with a release lever cam 34 disposed to interfere with and engage the release collar 66, shown in FIGS. 5-8, surrounding the crowd assembly 60 of the hydraulic pump assembly 80 when the distal end of the release handle 16 is activated by a user. As illustrated, the hydraulic cylinder assembly 50 is suspended between pivot pin 54 at the front end and the pivot pin 52 at the rear end, an arrangement that permits the hydraulic pump assembly 50 front yoke 18 to move with the lower serrated jaw 26 thereby eliminating the need for additional mechanical linkages that would be required if the hydraulic cylinder assembly 50 were fixed stationary within the upper stationary handle 12. The arrangement has the further advantage of maximizing load transfer to the lower serrate jaw 22.

Figure 4:
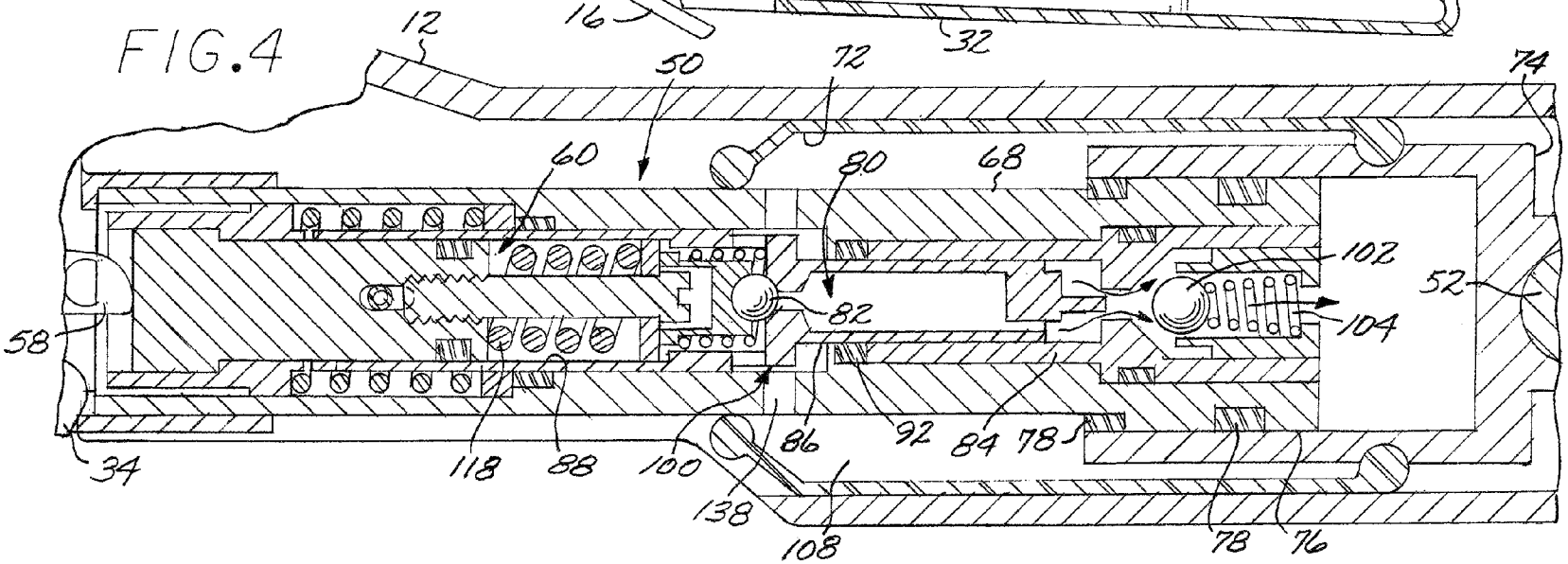
FIG. 4 is a sectional view of the illustration of FIG. 3 showing the press pliers in the forward stroke configuration wherein the crowd assembly and hydraulic pump assembly compress hydraulic fluid in the pump cylinder by the lower moving handle lever activation. The hydraulic fluid is further forced into the tool cylinder cavity by fluid transfer from the pump cylinder.

As shown in more detail in FIG. 4, the hydraulic cylinder assembly 50 tool cylinder 74, forming the rear end of the assembly, slidably receives the outside circumference of the cylindrically shaped tool piston rod 76 portion of the tool piston 68 functioning as a piston for tool cylinder 74. The tool cylinder 74 is cylindrically shaped having a bottom with a flange portion extending outwardly from the bottom of the cylinder 74. The flange receives and retains the hydraulic cylinder assembly rear pivot pin 52 pivotally attaching the rear end of the hydraulic cylinder assembly 50 to the upper stationary handle 12. The outside circumference of the rear portion of tool piston 68, forming the tool piston rod 76, is inserted into the tool cylinder 74 thus forming a hydraulic piston for the tool cylinder 74. Tool cylinder seals 78 disposed around the tool piston rod 76 and within the tool cylinder 74 inside circumference confines hydraulic fluid within the cylinder 74 notwithstanding flow through the centrally disposed pump check valve 102. As the tool piston 68 front end is fixed to yoke 18, hydraulic fluid received by the tool cylinder 74 through check valve 102 necessary forces the two ends of the hydraulic cylinder assembly 50 apart analogous to the action of a typical hydraulic cylinder.

The hydraulic pump assembly 80 is centrally and longitudinally disposed within the tool piston 68 comprising the pump cylinder 84, the pump piston assembly 100 with the rear end being a pump piston 86 and the front end being a valve and manifold housing 88, the pump ball valve 82 centrally disposed between the pump piston 86 and the valve and manifold housing 88, and the crowd assembly 60 disposed within the valve and manifold housing 88 and contacting the pump ball valve 82. As in FIG. 4, the pump piston 86 portion of the pump piston assembly 100 is cylindrically shaped and slidably received by the pump cylinder 86 with pump seal 92 disposed between the inside circumference of the pump cylinder 84 and the outside circumference of the pump piston 86 together forming a hydraulic piston pump within the apparatus. The crowd assembly 60 slidably disposed within the front end of the pump piston assembly 100 and being in direct contact with the lower moving handle pump lever 58 and further being in direct contact with the pump ball valve 82 closes the ball valve 82 when compressed while also transferring motion from the lower moving handle pump lever 58 directly to the hydraulic pump piston assembly 100 through the surrounding valve and manifold housing portion 88 forcing the pump piston portion 86 into the pump cylinder 84 producing a forward stroke of the pump to compress fluid within the pump cylinder 84.

In this forward stroke configuration of FIG. 4, crowd assembly 60 seats the pump ball valve 82 trapping hydraulic fluid within the pump cylinder 84 and compressing the fluid as the pump piston portion 86 moves into the pump cylinder 84 as accomplished by the motion of the lower moving handle 14. With hydraulic fluid pressures high enough to overcome the check valve load spring 104 and fluid pressures within the tool cylinder 74, the pump check valve 102 opens and fluid flows into the tool cylinder 74 increasing the volume and pressure within the tool cylinder 74 forcing the hydraulic cylinder assembly 50 to responsively lengthen.

Figure 5:
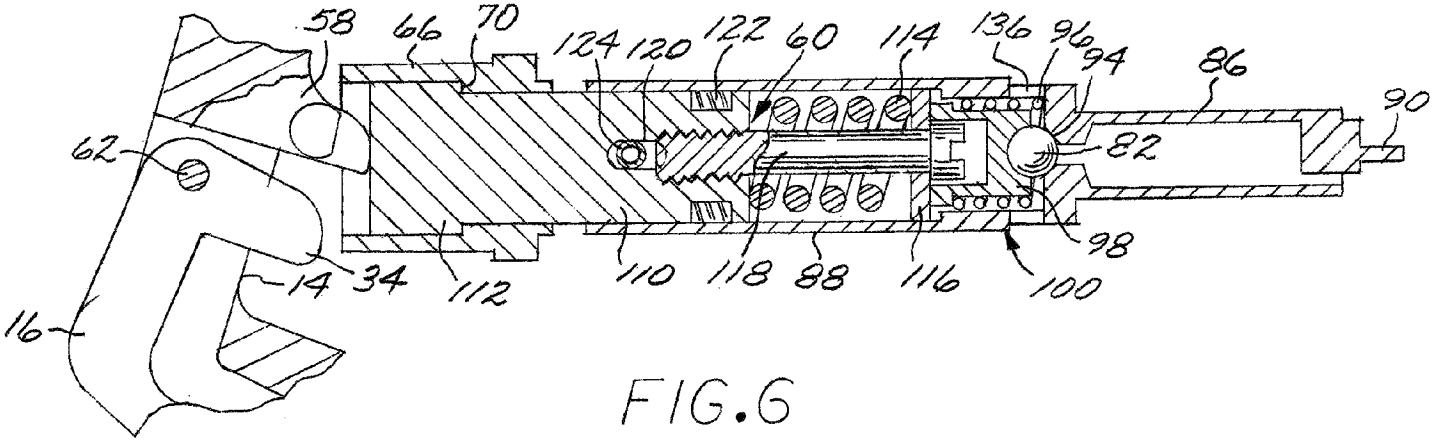
FIG. 5 is a sectional view similar to the illustration of FIG. 3 showing details of the various elements of the crowd assembly, the hydraulic pump piston assembly and the release collar. The elements have a spatial relationship consistent with the forward stroke configuration of the press pliers.

In FIG. 5, the hydraulic pump piston assembly 100 is illustrated separately wherein the piston portion 86 has a central cavity with hydraulic fluid flow connectivity to the pump ball valve 82 at the front end and a hydraulic fluid pathway at the rear end with connectivity with the pump cylinder 84. The pump piston portion 86 further comprises a push pin 90 centrally and longitudinally disposed extending from the rear end of the pump piston portion 86 having a length sufficient to lift the tool cylinder check valve 102 from the valve seat for venting hydraulic fluid from the tool cylinder 74 as required during a reversing stroke.

Figure 6:
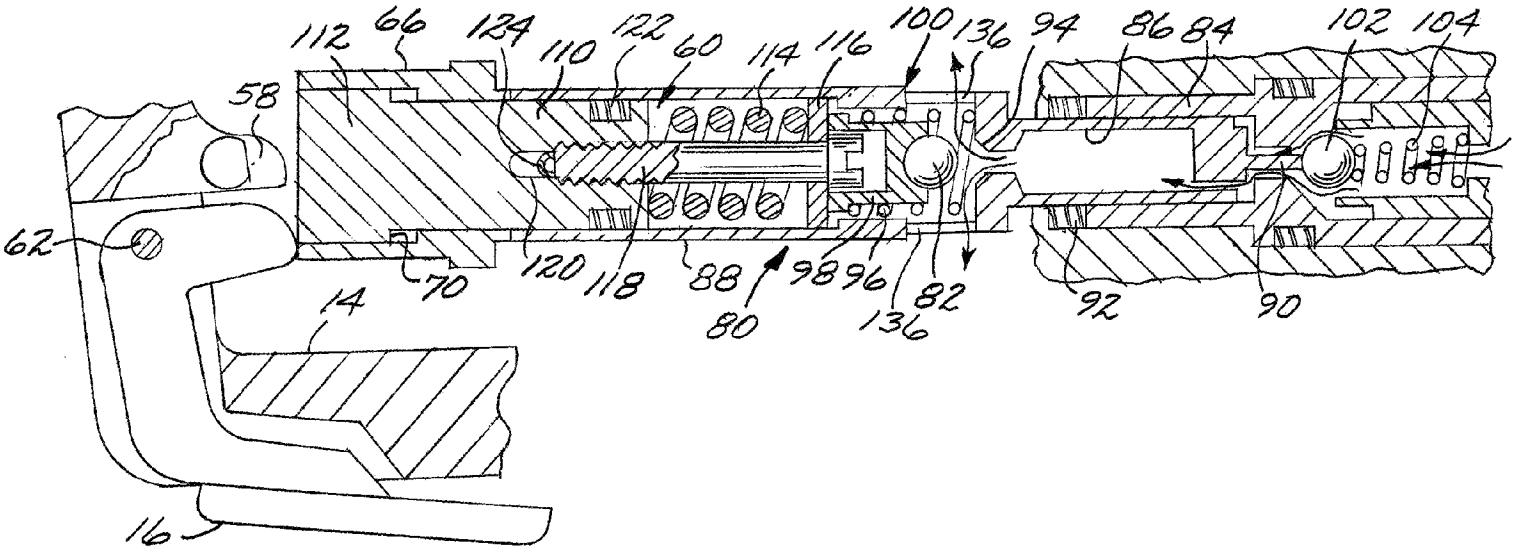
FIG. 6 is a sectional view according to the present invention similar to FIG. 5 showing details of the various elements of the crowd assembly, the hydraulic pump piston and cylinder wherein the pump piston is disposed within the pump cylinder with the release collar being depressed by the release lever cam thrusting the push off pin of the pump piston forward. The elements have a spatial relationship consistent with the reverse stroke configuration of the press pliers.

FIG. 6 shows pump piston portion 86 of the hydraulic pump piston assembly 100 being received by the pump cylinder 84 with the pump piston portion 86 fully inserted into the pump cylinder 84 as in the reversing stroke of the press pliers 10. Note that push pin 90 is contacting and lifting pump check valve 102 open permitting hydraulic fluid flow back into the pump cylinder 84, through the reservoir vents 136 of the pump piston assembly 100, and eventually out through the tool piston assembly reservoir vents 138.

Of particular interest is the crowd assembly 60 disposed within the cylindrically shaped valve and manifold housing 88 being the front end of the pump piston assembly 100 as an assemblage of elements is critical to the operation of the apparatus. The crowd assembly 60, according to the present invention, is a key component of the hydraulic cylinder assembly 50 providing a means for combing multiple essential hydraulic pump elements into a single component thereby significantly reducing the cost and improving the reliability of tool. Referring to FIGS. 5 and 6, the crowd assembly 60 and piston ball valve 82 combination facilitates the three operating modes of the assembly; the forward stroke, the back stroke, and reversing or releasing stroke. The crowd assembly 60 comprises a cylindrically shaped crowd primary piston 110 slidably disposed within the front end of the valve and manifold housing 88 cavity having a circumferentially expanded portion 112 at the front end wherein the diameter of the expanded portion is equal to the outside diameter of the hydraulic pump piston assembly 100. The front end of the crowd primary piston 110, being solid, is pressed by the lower moving handle lever 58 moving the crowd primary piston 110 into the valve and manifold housing 88 cavity closing pump ball valve 82. With the pump ball valve 82 now closed further depression of the lower moving handle 14 compresses crowd spring 114 centrally disposed within the valve and manifold housing 88. The crowd spring 114 is captured between the rear end of the crowd primary piston 110 and crowd washer 116 being centrally secured by crowd spring bolt 118 threaded into the rear end of the crowd primary piston 110. The crowd primary piston 110 longitudinal travel is limited inwardly by the interference of the raised ring portion 70 of release collar 66 and the front end of the pump piston assembly 80 as the raised ring portion 70 is disposed between the circumferentially expanded portion 112 of the release collar 66 and the front end of the piston assembly 100. The outward longitudinal travel is limited by the interference between the crowd assembly pin 124 and the rear end of the crowd assembly capture slot 120 disposed through the diameter of the crowd primary piston 110. Crowd wiper seal 122 disposed between the crowd primary piston 110 and the inside circumference of the valve and manifold housing 88 confines hydraulic fluid within the valve and manifold housing 88. Slot 120 is elongated to allow the crowd primary piston 110 to move laterally. The crowd assembly pin 124 is perpendicularly fixed across the diameter of the valve and manifold housing 88 and through capture slot 120. The crowd assembly 66 presses the pump ball valve 82 closed against pump ball valve seat 94 as the crowd assembly 66 is compress during a forward stroke sealing hydraulic fluid within the cavity of the pump piston portion 86 as in the configuration illustrated in FIG. 5.

Returning to FIG. 4, during the forward stroke, the captured hydraulic fluid lifts the pump check valve 102 from its seat and flows into the tool cavity 74. In the event of over pressuring of the press pliers, the crowd spring 114, having a predetermined spring constant compresses, allowing pump ball valve 82 being biased open by pump valve spring 96 disposed around and between the ball valve pedestal 98 and the valve and manifold housing 88, therein allowing hydraulic fluid to flow through the reservoir vents 136 penetrating the valve and manifold housing 88 then through the tool piston assembly reservoir vents 138 and back to the hydraulic fluid reservoir 108 encircling a portion of the outside circumference of the tool piston 68 and the a portion of the outside circumference of the tool cylinder 68 of the hydraulic cylinder assembly 50 and defined by a flexible hydraulic reservoir bladder 72.

Figure 7:
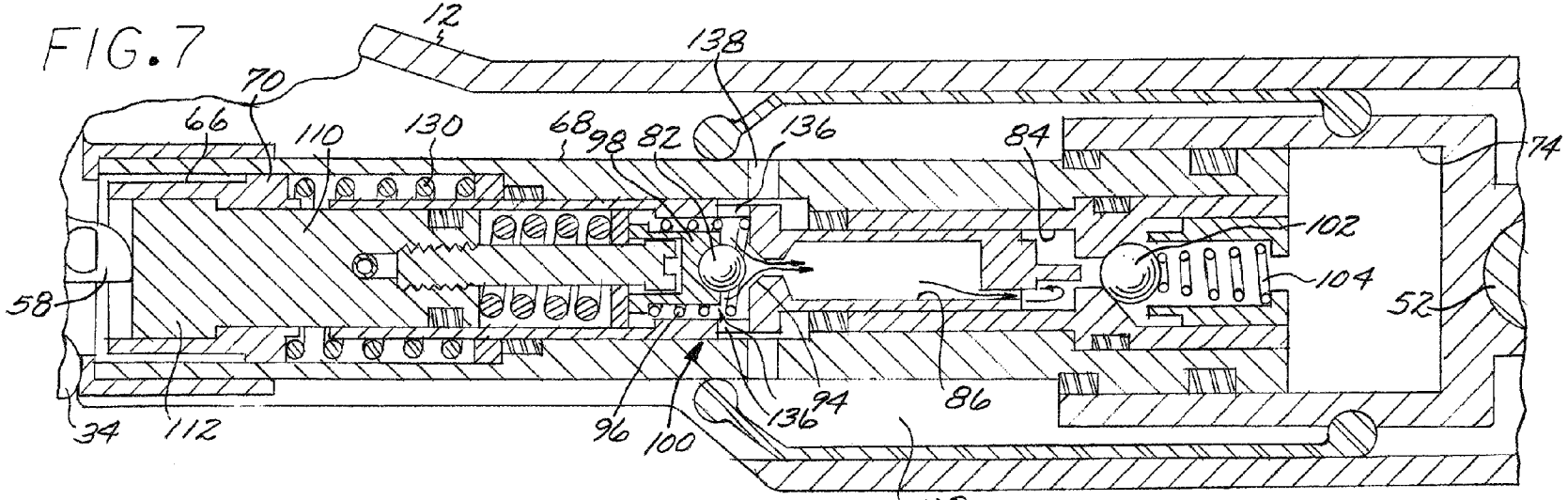
FIG. 7 is a sectional view according to the present invention similar to FIG. 4 illustrating the back stroke configuration wherein the lower moving handle lever is retracted from the crowd assembly thereby moving the crowd assembly outwardly from the pump piston assembly facilitating a replenishment of the pump cylinder with hydraulic fluid from the hydraulic fluid reservoir thereby preparing the pump for the next forward stroke.

In the back stroke configuration of FIG. 7, the lower moving handle 14 pivots downward from the tool upper stationary handle 12 in preparation for a subsequent compression by the user, the rotation is assisted by handle return spring 130 disposed between the release collar 66 and the tool piston 68. The handle return spring 130 also retracts the pump piston assembly 100 when the release collar raised ridge 70 engages the crowd primary piston expanded portion 112. During this back stroke, the pump ball valve 82 lifts from valve seat 94 by the bias of ball valve spring 96 around the pedestal 98. The pump check valve 102 is now closed, holding fluid within tool cylinder 74. Also during this back stroke, the pump piston portion 86 is retracted from the pump cylinder 84 thereby facilitating a hydraulic fluid flow from the hydraulic fluid reservoir 108 through the hydraulic fluid reservoir vents 136 and 138 past the now open pump valve 82 and into the pump cylinder 84 thereby replenishing lost fluid from the previous forward stroke. The pump cylinder 84 is now filled with fluid in preparation for the next forward stroke.

Figure 8:
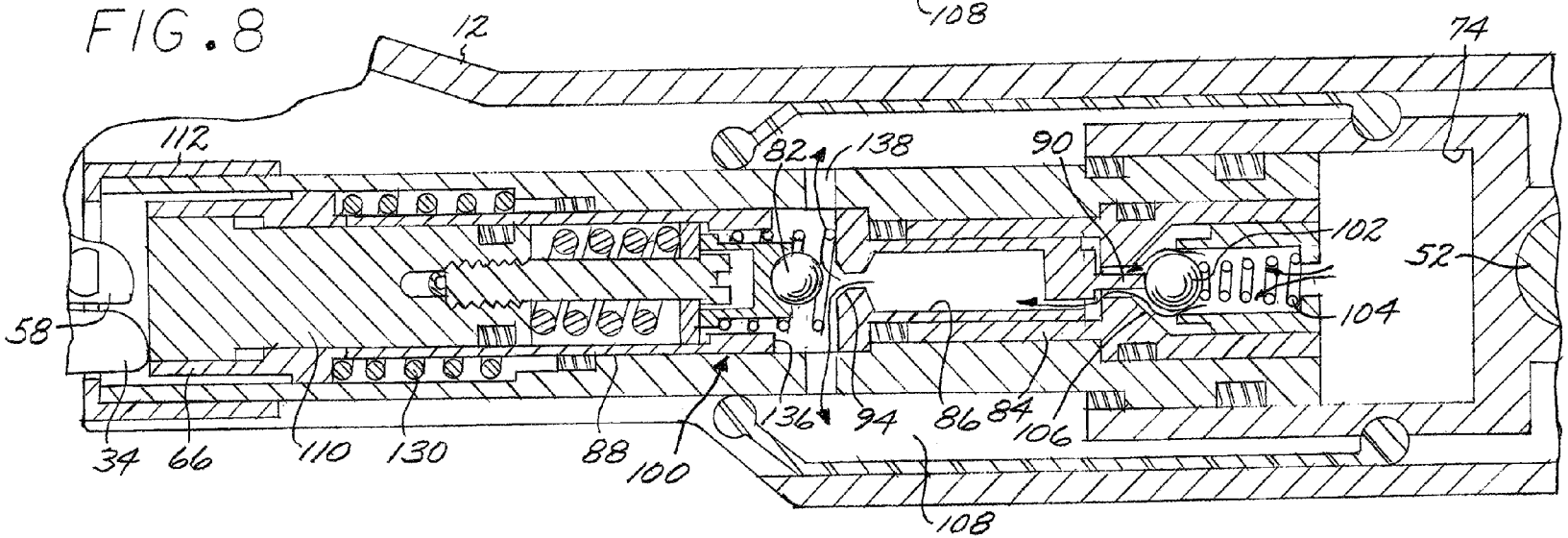
FIG. 8 is a sectional view according to the present invention similar to FIG. 4 illustrating the reversing or release configuration wherein the various elements are arranged to relieve the hydraulic pressure within the tool cylinder when activated by disposing the release lever cam over the release collar of the hydraulic pump assembly absent forward motion of the crowd assembly and moving the pump piston forward into the pump cylinder wherein the push pin portion of the pump piston is disposed to lift the pump check valve ball and relieving hydraulic fluid from the tool cylinder.

In the release configuration of FIG. 8, the release lever cam 34 is rotated into position to interfere with the release collar 66. The release lever cam 34 is pivoted around release lever pin 62 fixed to the lower moving handle 14 and into position when the user depresses the release lever handle 16 whilst also depressing the lower moving handle 14. The motion compresses the handle return spring 130 until the release collar 66 contacts the valve and manifold housing 88 of the hydraulic pump piston assembly 100. The pump piston portion 86 is pressed further into the pump cylinder 84 whilst the crowd assembly 60 remains inactive and disengaged from the pump ball valve 82 permitting the ball valve 82 to lift from the valve seat 94 providing direct hydraulic fluid connectivity between the pump cylinder 84 and the hydraulic fluid reservoir through hydraulic fluid reservoir vents 136 and 138. As the hydraulic pump piston assembly 100 moves deeper into the pump cylinder 84, the piston push pin 90 lifts the pump check valve 102 from the valve seat 104 allowing fluid within the tool cylinder 74 to flow back into the pump cylinder 84. In this reversing or releasing configuration there is direct hydraulic fluid communication between the tool cylinder 74 and the hydraulic fluid reservoir 108 thereby allowing the fluid volume and pressure to vent allowing the hydraulic cylinder assembly 50 to shorten in length. The low pressure within the hydraulic cylinder assembly 50 relieves the pressure between the serrated jaws 22 and 28 releasing a work piece disposed between the jaws. The tool piston 68 may now be moved into the tool cylinder further as the hydraulic fluid pressure is now relieved allowing the shortening of the hydraulic cylinder assembly 50. Releasing the hydraulic fluid with the reversing lever 16 allows the hydraulic fluid to return to the reservoir 108 releasing the pressure on a work piece; however, retraction and separation of the jaws 22 and 26 requires a further shortening of the hydraulic cylinder assembly 50, is user facilitated by a downward movement of the lower serrated jaw 26. The lower serrated jaw lip 40, disposed on the front end of the lower serrated jaw 26 provides a lever for a user to depress to accomplish retraction and separation of the jaws 22 and 26 with the tool in this reverse or release configuration.

What is claimed is:

1. A hand operated hydraulic press pliers tool comprising
- an upper stationary handle having an upper jaw forming the front end of the upper stationary handle,
- a lower jaw having front and rear ends being pivotally fixed to the upper stationary handle disposed to oppose the upper jaw,
- a hydraulic cylinder assembly disposed longitudinally within the upper stationary handle and having a rear end being a cylindrically shaped tool cylinder having a bottom pivotally fixed to the upper stationary handle near the upper stationary handle rear end, and a front end being a yoke pivotally fixed to the lower jaw at a location offset between the lower jaw front end and the lower jaw rear end, the hydraulic cylinder assembly comprising
  - a tool piston assembly being cylindrically shaped and having a tool piston assembly front end fixed to the yoke and a tool piston assembly rear end being a cylindrically shaped tool piston rod slidably received by the tool cylinder,
  - a hydraulic pump assembly longitudinally and concentrically disposed within the tool piston assembly comprising
    - a pump piston assembly having
      - a valve and manifold housing being the front end and having a cylindrical shape with an inside circumference,
      - a crowd assembly longitudinally and concentrically arranged within the valve and manifold housing,
      - a pump piston being the rear end, and
      - a pump ball valve disposed between the crowd assembly of the valve and manifold housing and the pump piston, and
    - a hydraulic pump assembly pump cylinder, having a bottom and slidably receiving the pump piston, with a pump check valve disposed centrally in the bottom of the pump cylinder, the hydraulic pump assembly having hydraulic fluid direct communication between the pump ball valve and the pump cylinder wherein pressing the crowd assembly into the valve and manifold housing closes the pump ball valve sealing hydraulic fluid within the pump cylinder and opens the pump check valve creating direct hydraulic fluid communication between the pump cylinder and the tool cylinder; and, a lower moving handle having a distal end, a proximate end pivotally fixed by a pivot pin to the yoke, and a pump lever disposed near the lower moving handle proximate end and arranged to contact the hydraulic pump assembly of the hydraulic cylinder assembly, and adapted to activate the tool by a user pressing the lower moving handle and the upper stationary handle together to roate the lower moving handle around the proximate end pivot pin moving the distal end towards the upper stationary handle thereby pressing the pump lever towards the hydraulic pump assembly, activating the hydraulic pump assembly, forcing hydraulic fluid into the tool cylinder of the hydraulic cylinder assembly, lengthening the hydraulic cylinder assembly and forcing the upper and lower jaws to close.

2. The press pliers of claim 1 wherein the rear end of the upper stationary handle is a tubular portion.

3. The press pliers of claim 2 wherein a dust cap is fixed to the rear end of the upper stationary handle.

4. The press pliers of claim 1 wherein the tool rod piston has an outside circumference, the tool cylinder has an inside circumference, and the hydraulic cylinder assembly further comprises a tool rod piston seal disposed between the tool rod piston outside circumference and the tool cylinder inside circumference.

5. The press pliers of claim 1 wherein the crowd assembly further comprises a crowd primary piston being cylindrically shaped and having a circumferentially expanded portion being the front end of the crowd primary piston and having a back end receiving a crowd spring bolt retaining a crowd spring between a crowd washer retained by the crowd spring bolt and the back end of the crowd primary piston, and the crowd washer contacting a pump ball valve pedestal holding the pump ball valve in position, the pump ball valve pedestal being surrounded by a pump ball valve spring biasing the pump ball valve open allowing hydraulic fluid flow into the pump cylinder being a back stroke configuration and hydraulic fluid flow out of the pump cylinder being a release stroke configuration.

6. The press pliers of claim 5 wherein the crowd spring is biased to permit the pump ball valve to open when hydraulic fluid pressures within the pump cylinder exceed a preset load capacity of the hydraulic cylinder assembly.

7. The press pliers of claim 1 wherein the pump piston has a push pin extending outwardly and forming the rear end of the pump piston.

8. The press pliers of claim 1 wherein the valve and manifold housing has reservoir vents disposed adjacent to the pump ball valve.

9. The press pliers of claim 8 wherein the hydraulic cylinder assembly further comprises a hydraulic fluid reservoir bladder having front and rear ends, the front end sealed against the outside circumference of the tool piston assembly and the rear end sealed against the outside circumference of the tool cylinder, the tool piston assembly having reservoir vents in direct hydraulic fluid communication with the valve and manifold housing reservoir vents.

10. The press pliers of claim 5 wherein the crowd assembly further comprises a longitudinally arranged crowd capture slot across the diameter of the crowd primary piston with a crowd pin fixed to the valve and manifold housing and disposed within the crowd capture slot wherein the longitudinal travel of the crowd assembly is limited within the valve and manifold housing.

11. The press pliers of claim 5 wherein the tool piston assembly further comprises a release collar having a raised ridge forming the rear end and disposed between the crowd primary piston expanded portion and the front end of the valve and manifold housing, a lower moving handle return spring further disposed between the release collar and the hydraulic pump piston assembly biasing the lower moving handle away from the upper stationary handle through the crowd primary piston expanded portion engaging the pump lever of the lower moving handle, and a front end receiving a release lever cam being the proximate end of a release handle pivotally attached to the lower moving handle wherein the release lever cam pressing the release collar compresses the lower moving handle return spring until the release collar contacts the hydraulic pump piston assembly moving the pump piston to contact and open the pump cylinder check valve.

12. The press pliers of claim 1 further comprising a lower moving handle grip surrounding the distal end of the lower moving handle.

13. The press pliers of claim 1 wherein the upper jaw has downwardly facing serrations and the lower jaw has upwardly facing serrations opposing the serrations of the upper jaw.

14. The press pliers of claim 1 wherein the front end of the lower jaw has a lip extension wherein depressing the extension moves the upper and lower jaws apart when the hydraulic cylinder assembly is vented.

15. The press pliers of claim 5 wherein the crowd assembly further comprises a wiper seal disposed between the outside circumference of the crowd primary piston and the inside circumference of the valve and manifold housing.

* * * * *